United States Patent [19]

Nilon et al.

[11] 4,144,914

[45] Mar. 20, 1979

[54] METHOD FOR RAPIDLY DISPENSING BEER INTO OPEN CUPS

[75] Inventors: John W. Nilon; Thomas J. King, both of Ridley, Pa.

[73] Assignee: Nilon Bros., Philadelphia, Pa.

[21] Appl. No.: 776,724

[22] Filed: Mar. 11, 1977

Related U.S. Application Data

[60] Division of Ser. No. 605,435, Aug. 18, 1975, Pat. No. 4,011,896, which is a continuation of Ser. No. 284,103, Aug. 28, 1972, abandoned.

[51] Int. Cl.[2] ..... B65B 3/04

[52] U.S. Cl. ..... 141/11; 141/82

[58] Field of Search ..... 141/1-12, 141/82, 129-191; 62/141, 188, 389, 390, 201; 222/1, 394, 146 C; 53/22, 25, 35, 79, 127, 281, 282

[56] References Cited

U.S. PATENT DOCUMENTS

| | | | |
|---|---|---|---|
| 3,065,775 | 11/1962 | Schroeder | 222/146 C |
| 3,892,335 | 7/1975 | Keves | 141/131 |
| 4,011,896 | 3/1977 | Nilon et al. | 141/82 |

*Primary Examiner*—Houston S. Bell

*Attorney, Agent, or Firm*—Woodcock, Washburn, Kurtz & Mackiewicz

[57] ABSTRACT

Beer is stored in vessels located in a refrigerated storage area before passing through dispensing lines connected to a plurality of dispensing taps. The dispensing lines are maintained in heat-exchanging relationship with cooling apparatus which further depresses the temperature of the beer below that of the refrigerated storage area. By the time the beer reaches the cooling taps, the temperature of the beer is sufficiently depressed so as to permit the beer to be dispensed at a high rate into drinking containers which pass beneath the taps.

13 Claims, 3 Drawing Figures

METHOD FOR RAPIDLY DISPENSING BEER INTO OPEN CUPS

This is a division of application Ser. No. 605,435 filed Aug. 18, 1975, now U.S. Pat. No. 4,011,896, which is a continuation of application Ser. No. 284,103 filed Aug. 28, 1972, now abandoned.

BACKGROUND OF THE INVENTION

1. Field of the Invention

This invention relates to beer dispensing systems, and more particularly, to high volume beer dispensing systems.

High volume beer dispensing systems are required in present day sports stadiums and arenas where it is necessary to provide beer to large numbers of people in a relatively short period of time. In general, it is not desirable to serve beer in original containers, i.e., bottles/or cans, since these containers may be thrown at the sporting participants or other spectators by individuals consuming the beer. It therefore becomes necessary to provide beer in light-weight drinking containers such as plastic or paper cups. Such containers do not present a hazard to the sporting participants or spectators. Furthermore, maintainance of the stadium or arena is much easier when cups are utilized rather than bottles or cans.

When light-weight containers are utilized, the problem of pouring beer quickly into large numbers of containers becomes a considerable problem. It is of course well known that when beer is poured slowly into a container, it will pour flat, i.e., without a head. When beer is poured fast, a large head will form and only a portion of the container will be filled with beer.

The magnitude of this problem becomes overwhelming when one considers that many sports stadiums and arenas seat at least 50,000 people and a concessionaire, on a warm day, may find itself pouring as many as 25,000 cold beers during a 2½ hour sporting event. In other words, the concessionaire will be asked, on the average, to pour approximately 10,000 beers per hour or about three beers per second.

In order to meet these needs, the number of concession stations may be scattered around a stadium with each station pouring beers as fast as they can to meet this demand. Even so, it is difficult to pour beer fast enough in certain instances to keep up with the demand due to the tendency of the beer to form a head when it is poured rapidly.

2. The Prior Art

In the prior art beer dispensing systems, the beer is stored in kegs located within a refrigerated storage area with the temperature of the storage area maintained at approximately 36° F. The beer then moves out of the storage area through dispensing lines to a plurality of taps where it is dispensed into drinking containers which are passed beneath the taps. With this arrangement, it is difficult to pour beer fast in sufficient quantity to meet the demand. Since concessionaires strive to maintain the maximum per capita, i.e., sales per spectator, pouring beer at a rate sufficient to meet the demand is very important. In general, these prior art systems have not been able to meet this demand and the concessionaires have not maximized their per capita.

SUMMARY OF THE INVENTION

It is an object of this invention to dispense or pour beer flat into large numbers of drinking containers at a rapid rate.

In accordance with this object, a preferred embodiment of the invention comprises a method of dispensing beer into successive open cups by cooling the beer to a sufficiently low temperature so as to permit the beer to be dispensed at a rapid rate without a substantial head as compared with the head typically formed at a dispensing temperature above 32° F. The method comprises the steps of storing the beer in a vessel and flowing the beer from the vessel through at least one dispensing line to a dispensing area. The beer is cooled between the vessel and the dispensing area so as to dispense the cooled beer into the cups at a temperature below 32° F. as the cups move through the dispensing area.

In the preferred embodiment of the invention, the beer is dispensed at a temperature substantially below 32° F., as for example, 27° F.

The step of cooling may occur simultaneously with the step of flowing the beer to the dispensing area. In the preferred embodiment, this is accomplished by flowing a coolant in a coolant line which is in heat exchanging relationship with at least one dispensing line. Preferably, the coolant is at a temperature of approximately 22° F.

The moving step and the dispensing step may occur continuously or discontinuously. Where the moving step and the dispensing step are discontinuously occuring, the moving step is completed before the dispensing step is initiated.

In the preferred embodiment of the invention, the beer is dispensed flat into the cups at a rate of at least 1 to 3 fluid ounces per second.

The beer may be dispensed by a plurality of dispensing taps adapted to dispense beer into successive pluralities of cups where the moving step comprises sequentially moving each plurality of the successive pluralities of cups into alignment with the taps. The beer may then be dispensed simultaneously from all of the taps.

DETAILED DESCRIPTION OF A PREFERRED EMBODIMENT

Figure 1A:
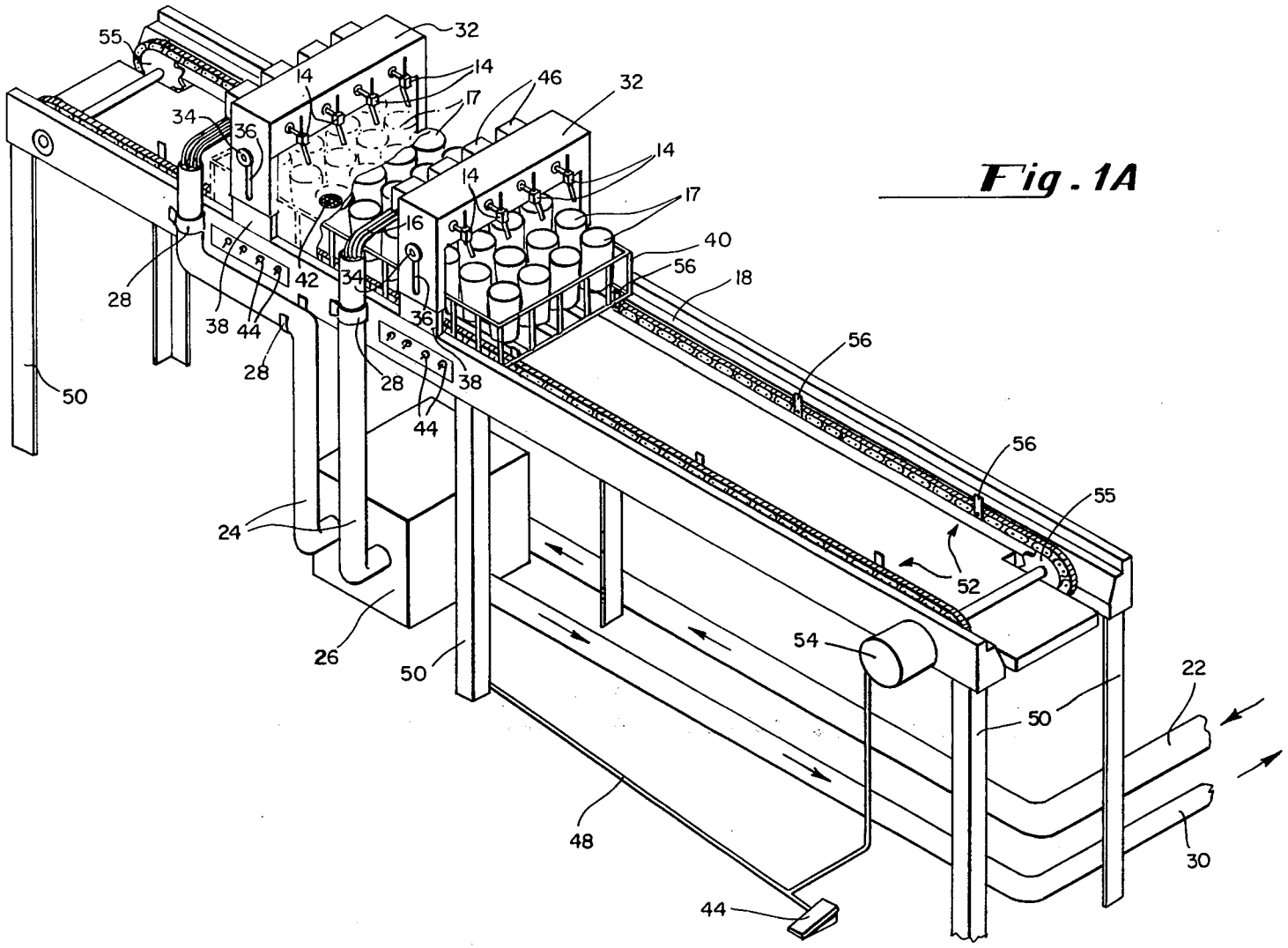
FIGS. 1*a* and 1*b* are perspective views of a dispensing system constructed in accordance with this invention.
Figures 1B, 2:
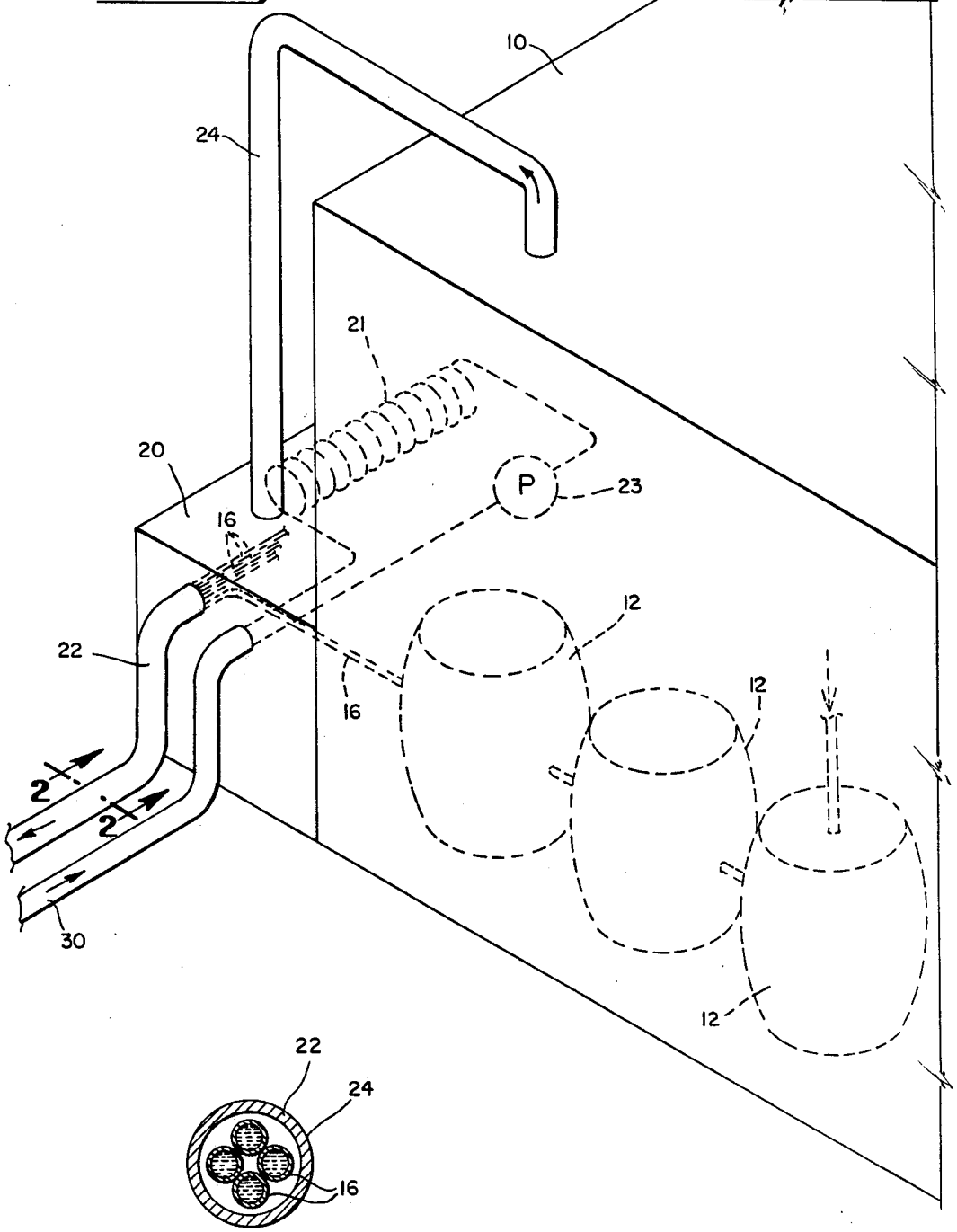
FIG. 2 is a sectional view of the coolant and beer dispensing lines taken along lines 2—2 of FIG. 1*b*.

Referring to FIGS. 1*a* and 1*b*, a dispensing system constructed in accordance with this invention comprises a refrigerated storage compartment 10 containing a plurality of series connected vessels or kegs 12 which are connected to a plurality of beer dispensing taps 14 through beer dispensing lines 16. As light-weight containers 17 in the form of paper or plastic drinking cups are conveyed beneath the taps 14 through a conveyor channel 18, beer is dispensed into the containers 17.

In accordance with one important aspect of the invention, the beer leaving the vessels 12 in the compartment 10 is further cooled to a temperature substantially below 32° F. at the taps 14 so as to permit the beer to be dispensed or poured flat into the drinking containers 12. This is achieved by providing a dispenser cooler 20 located adjacent the refrigerated storage compartment 10 which, through the use of cooling coils 21 and a circulating pump 23, lowers the temperature of a suitable coolant to approximately 22° F. This coolant is then placed in heat-exchanging relationship by providing a coolant line 22 which surrounds a plurality of dispensing lines 16 as best shown in FIG. 2. Thus, as the coolant passes through the coolant line 22 in heat-exchanging relationship with a substantial portion of the dispensing lines 16, the beer within the dispensing lines 16 is lowered to the desired temperature, e.g., approximately 27° F. The dispenser cooler may comprise a K-WAY dispenser Model Super, Style 23954.

Although beer is generally believed to freeze at 27° F., it has been found that the freezing temperature of beer is actually somewhat lower than 27° F. Furthermore, it has been discovered that this depressed temperature is ideal for pouring beer since it allows the beer to be poured into the drinking containers in a substantially flat or headless manner at rates in excess of one fluid ounce per second from each tap with rates as high as three fluid ounces per second preferred. This permits a twelve ounce cup to be filled in four seconds.

In order to maintain this depressed beer temperature at the taps 14, the dispensing lines 16 are enclosed within a suitable insulating cover 24 as the beer moves from the refrigerated compartment 10 into the dispensing cooler 20. A similar cover 24 is also provided for the dispensing lines 16 between a dispensing box 26 and the taps 14. The covers 24 are secured to the sides of the conveyor channel 18 by clamps 28.

The principal function of the dispensing box 26 is to separate beer lines 16 from the coolant which flows back to the dispenser cooler 20 through a return line 30. Since the coolant does flow over the exterior of the dispensing lines 16, there is of course some risk that some coolant may enter the lines 16 due to a break. For this reason, the coolant should comprise a non-poisonous, preferably tasteless material so as to preclude the possibility of beer contamination. Of course, the coolant must not freeze at temperatures as low as 22° F. For this purpose, Union Carbide Proplylene Glycol U.S.P. has been found to be particularly suitable.

As shown in FIG. 1, two sets of taps, comprising four taps each, are mounted on a pair of bridges 32 which span the channel 18. In order to permit the use of containers 17 of various sizes, the bridges 32 are adjustable in height by providing threaded fasteners 34 which cooperate with slots 36 in vertical extending legs of the bridge member 32. The fasteners 34 pass through openings in upstanding members 38 which are supported by the channel 18.

By providing the two sets of taps 14 which are spaced along the channel 18 in a dispensing area, it is possible to pour eight containers 17 at any one time. Of course, more bridges 32 could be provided and each bridge could include more taps. However, the configuration shown in FIG. 1 is preferred since it is particularly well suited for the use of filling containers 17 which are mounted in a 24 cup portable rack 40 which is readily carried by vendors.

In accordance with one aspect of the invention, the containers 17 in the racks 40 may be conveyed through the channel 18 at a relatively rapid rate while beer is being dispensed out of the taps 14 at a rather fast flow rate. In this connection, taps 14 are, in the preferred mode, opened up so as to continuously dispense beer into the containers 17. The containers 17 are then indexed from position-to-position beneath taps 14 by conveyor 50. Although there is some spillage as the containers 17 move from one position beneath the taps 14 to the next position, this spillage does not create a serious problem since drains 42 are provided within the channel 18.

The taps 14 may be set individually to opened or closed positions by solenoid on/off switches 44 which are located along the sides of the channel 18. When the switches are set, the taps operate in a continuous filling mode. Since it may be desirable to operate the taps 14 in a discontinuous mode, a foot pedal 44 is also provided. The foot pedal 44 is connected to solenoid-actuated a valves 46 which are carried by the bridge members 32 which support the taps 14 in the channel 18 through a line 48 which extends along the floor to one of a plurality of vertical legs 50. Depression of the foot pedal 44 serves to actuate the solenoid-actuated valves 46 so as to dispense beer into empty containers 17 located beneath the taps 14. Release of the foot pedal 44 energizes a conveyor motor 51 to index the rack conveyor 52 comprising chains 54, sprockets 55 and rack engaging detents 56 to the next position. Depression and release of the foot pedal 44 again repeats the process until all of the containers 17 have been filled. Although this mode of operation is somewhat slower than the continuous dispensing mode, it does assure less spillage of beer. Note that the conveyor 52 may be indexed two cups at a time so that the taps 14 on each bridge 32 only fill alternate rows with the taps 14 on the other bridge 32 filling the rows in between. It will of course be understood that the taps 14 of one bridge 32 can be filling all containers 17 in one rack 40 while the taps 14 of the other bridge 32 are filling all containers 17 in the other rack 40. It will also be understood that the containers 17 may be indexed from position-to-position by hand.

Although not shown, a capping apparatus may be provided above the channel 18 downstream of the taps 14. Such machines which are commercially available are capable of rapidly applying lids to the containers 17 so as not to impede the filling process.

Although a specific embodiment of the invention has been shown and described in detail and various modifications have been discussed, it will be understood that the appended claims are intended to cover the foregoing embodiment and modifications as well as all other embodiments and modifications as fall within the true spirit and scope of the invention.

What is claimed:

1. The method of dispensing beer into successive open cups by cooling the beer to a sufficiently low temperature so as to permit the beer to be dispensed at a rapid rate without a substantial head as compared with the head typically formed at a dispensing temperature above 32° F., said method comprising the following steps:

storing the beer in a vessel;

flowing said beer from said vessel through at least one dispensing line to a dispensing area;

cooling said beer between said vessel and said dispensing area;

moving cups through said dispensing area; and dispensing said cooled beer into said cups at a temperature below 32° F.

2. The method of claim 1 wherein said dispensing step comprises dispensing at a temperature substantially below 32° F.

3. The method of claim 2 wherein said dispensing step comprises dispensing at a temperature substantially below 32° F. such as 27° F.

4. The method of claim 1 wherein said cooling step occurs simultaneously with said flowing step.

5. The method of claim 4 wherein said sooling step comprises flowing a coolant in a coolant line which is in a heat exchanging relationship with said at least one dispensing line.

6. The method of claim 5 wherein said coolant is at a temperature of approximately 22° F.

7. The method of claim 1 wherein said moving step and said dispensing step are continuously occuring.

8. The method of claim 1 wherein said moving step and said dispensing step are discontinously occuring.

9. The method of claim 8 wherein said moving step is completed before said dispensing step is initiated.

10. The method of claim 1 wherein said dispensing step further comprises dispensing aid cooled beer at a rate of at least 1 to 3 fluid ounces per second, said beer being dispensed substantially flat into said cups.

11. The method of claim 1 wherein said dispensing area comprises a plurality of side-by-side dispensing taps adapted to dispense beer into successive pluralities of cups and wherein said moving step further comprises sequentially moving each plurality of said successive pluralities of cups into alignment with said taps.

12. The method of claim 11 wherein said beer is dispensed to each of the cups of each plurality simultaneously.

13. The method of claim 1 wherein said moving step comprises:

positioning said cups in a line; and successively passing each cup in said line through said dispensing area.

* * * * *

UNITED STATES PATENT AND TRADEMARK OFFICE

CERTIFICATE OF CORRECTION

PATENT NO. : 4,144,914
DATED : March 20, 1979
INVENTOR(S) : John W. Nilon and Thomas J. King It is certified that error appears in the above-identified patent and that said Letters Patent are hereby corrected as shown below:

Column 4, line 1 of claim 5, the word "sooling" should read --cooling--.

Column 5, line 2 of claim 8, the word "discontinously" should read --discontinuously--.

Column 5, claim 10, line 2, the word "aid" should read --said--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*